US009359811B2

(12) United States Patent
Hughes et al.

(10) Patent No.: US 9,359,811 B2
(45) Date of Patent: Jun. 7, 2016

(54) SILL DRAINAGE MEMBER

(75) Inventors: David George Hughes, Pokeno (NZ); Russell Leslie Gilden, Nelson (NZ); Graeme Francis Clarke, Dunedin (NZ); Christopher John Smith, Rotorua (NZ); Glenn Hughes, Auckland (NZ)

(73) Assignee: RETRO-FIT NZ LIMITED, Auckland (NZ)

( * ) Notice: Subject to any disclaimer, the term of this patent is extended or adjusted under 35 U.S.C. 154(b) by 0 days.

(21) Appl. No.: 13/809,778

(22) PCT Filed: Jul. 12, 2011

(86) PCT No.: PCT/NZ2011/000129

§ 371 (c)(1),
(2), (4) Date: Mar. 22, 2013

(87) PCT Pub. No.: WO2012/008854

PCT Pub. Date: Jan. 19, 2012

(65) Prior Publication Data

US 2013/0212962 A1 Aug. 22, 2013

(30) Foreign Application Priority Data

Jul. 12, 2010 (NZ) ..... 586749

(51) Int. Cl.
*E06B 7/14* (2006.01)
*E06B 1/70* (2006.01)

(52) U.S. Cl.
CPC .. *E06B 7/14* (2013.01); *E06B 1/702* (2013.01)

(58) Field of Classification Search
CPC ..... E06B 7/14; E06B 1/70; E06B 1/702; E04B 1/66; E04B 1/665; E02D 31/02; E02D 31/025
USPC ..... 52/209, 302.6, 58, 62, 745.15, 745.16; 49/471
See application file for complete search history.

(56) References Cited

U.S. PATENT DOCUMENTS 304,183 A * 8/1884 Davis ..... 52/97
1,677,130 A * 7/1928 Cherry ..... 52/209
1,945,816 A * 2/1934 Leigh ..... 52/209
(Continued)

FOREIGN PATENT DOCUMENTS

DE 102007019004 10/2008
EP 2431560 A1 * 3/2012 ..... E06B 1/70
(Continued)

OTHER PUBLICATIONS

International Search Report, PCT/NZ2011/000129, Dec. 7, 2011.
(Continued)

*Primary Examiner* — Brent W Herring
(74) *Attorney, Agent, or Firm* — Young & Thompson

(57) ABSTRACT

A sill drainage member for a window assembly which can include at least one sash. The sash includes a window pane in a frame which can be a single or double glazed window. The sill drainage member has an elongate body with an upper surface and lower surface. The upper surface includes drainage means which is adapted to drain moisture from a window sash. The sill drainage member is adapted to be located and fixed underneath a window sash. A method of installing the sill drainage member with slope blocks and double glazing units is also included and a method of retro fitting double glazed units in wooden sashes.

17 Claims, 13 Drawing Sheets

(56) References Cited

U.S. PATENT DOCUMENTS

| | | | | |
|---|---|---|---|---|
| 1,954,730 | A * | 4/1934 | Erickson | 52/302.1 |
| 2,122,926 | A * | 7/1938 | Blacher | 52/302.6 |
| 2,154,734 | A * | 4/1939 | Doing | 52/302.6 |
| 2,724,872 | A * | 11/1955 | Herbes | 52/553 |
| 3,638,372 | A * | 2/1972 | Rosenthal | 52/97 |
| 4,691,487 | A * | 9/1987 | Kessler | 52/209 |
| 4,730,429 | A * | 3/1988 | Roberts | 52/309.13 |
| 5,491,940 | A * | 2/1996 | Bruchu | 52/213 |
| 5,822,933 | A | 10/1998 | Burroughs et al. | |
| 5,921,038 | A * | 7/1999 | Burroughs et al. | 52/209 |
| 6,098,343 | A * | 8/2000 | Brown et al. | 52/11 |
| 6,385,925 | B1 * | 5/2002 | Wark | 52/209 |
| 6,606,823 | B1 * | 8/2003 | McDonough et al. | 47/65.9 |
| 7,059,087 | B2 | 6/2006 | Allen | |
| 7,290,379 | B2 | 11/2007 | Allen | |
| 7,367,164 | B2 * | 5/2008 | Burton et al. | 52/209 |
| 7,600,346 | B2 * | 10/2009 | Meeks | 49/471 |
| 7,607,270 | B2 * | 10/2009 | Ehrman et al. | 52/302.1 |
| 7,858,174 | B2 * | 12/2010 | Ehrman et al. | 428/299.7 |
| 8,443,554 | B1 * | 5/2013 | Teodorovich | 49/506 |
| 8,578,660 | B2 * | 11/2013 | Nolan et al. | 52/62 |
| 2004/0216414 | A1 * | 11/2004 | Dickinson | 52/506.01 |
| 2005/0072072 | A1 * | 4/2005 | Duncan et al. | 52/198 |
| 2006/0107604 | A1 | 5/2006 | Burton et al. | |
| 2006/0174545 | A1 * | 8/2006 | Young | 49/468 |
| 2008/0229676 | A1 | 9/2008 | Allen | |
| 2009/0272045 | A1 | 11/2009 | Teodorovich | |

FOREIGN PATENT DOCUMENTS

| | | |
|---|---|---|
| WO | WO 94/25718 | 11/1994 |
| WO | 2005068763 | 7/2005 |

OTHER PUBLICATIONS

Office Action, dated Jan. 30, 2015, in the corresponding Patent Application No. GB 1302006.0.

* cited by examiner

SILL DRAINAGE MEMBER

The invention relates to a sill drainage member for window glazing assemblies in buildings and to a method of installation. The invention is directed particularly but not solely towards timber windows for retro fitting double glazing.

BACKGROUND OF INVENTION

Typically drainage from timber joinery type windows is not specifically allowed for, in that there appear to be no specific design or apparatus that are used. Instead one tries to prevent water or moisture that originates from condensation or rainfall or anywhere, from entering or passing through a window. This is currently done by applying various sealing means such as by caulking guns or by installing flexible sealing strips. This drainage problem is especially apparent in Insulated Glass Units or as is commonly referred to as IGU's or as Double Glazing Units, i.e., DGU's whereby there can be fixed sashes or opening sashes.

Problems occur with his type of moisture prevention in window glazing assemblies, in that the flexible seals or strips, break down in sunlight. Also successful sealer installation is dependent on skilled installers and so is often improperly installed causing unintentional leaking into the building and into the internal wall framework.

Various flashings are often used in such situations to prevent entry of moisture in the walls of building but these do not address the problem of moisture of rotting timber sills in that moisture has to pass through any sill to get to the flashing to be directed away. Before moisture gets to the flashing the moisture meets any timber joinery which has no resistance.

Current moisture entry prevention methods are not able to provide a guarantee of weather tightness according to some warranties. This has been a real problem to installers meaning that no warranty has been able to be given to customers which has significantly reduced the desire to double glaze timber joinery windows for better noise and energy efficiency.

Methods of installing double glazing units cause problems for building owners, with a difficult and messy method of window removal caused by needing to remove the putty and the glass to get it out plus there is no guarantee of weather tightness. Such removal often involves glass breakage. This in turn causes there to be more costs to building owners with little incentive to improve current timber joinery which exists for many New Zealand residences.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

OBJECT OF THE INVENTION

It is an object of the invention to provide sill drainage member and method of installation that ameliorates some of the disadvantages and limitations of the known art or at least provide the public with a useful choice.

SUMMARY OF INVENTION

In a first aspect the invention resides in a sill drainage member for draining a window assembly which can include at least one window sash whereby the sash includes a window glazing assembly in a sash frame fixed in a window opening with a window sill, which window glazing assembly can be at least a single glazed window or insulated glass unit (IGU), resting on the sash bottom rail, the sill drainage member having an elongate body comprising a polygonal shape with an in use, upper surface and lower surface, the upper surface includes drainage means being adapted to drain moisture or fluid from a window sash wherein the drainage means includes at least one recess shaped and oriented to collect and direct moisture or fluid away from the sill drainage member such that the sill drainage member is installed directly below the window glazing assembly, which is on top of sash bottom rail.

Preferably, the in use lower surface of the sill drainage member includes member locating means in the form of at least one downwardly shaped protrusion which is shaped to slidably inter-fit with a recess in the sash bottom rail.

Preferably, the drainage means also includes a sloping upper surface to drain moisture away from the sill drainage member and/or into the recess.

Preferably, the elongate body of the sill drainage member is a substantially planar slender member having a length and width whereby the length is located substantially in an in use horizontal plane, having a longitudinal direction parallel with the length direction and a transverse direction located at right angles to the longitudinal direction, and the upper and lower surfaces are separated by a thickness dimension perpendicular to these surfaces in a vertical direction whereby there is a front edge, a rear edge and end edges wherein the sill drainage member can have an angled or horizontal lower surface.

Preferably, the drainage means includes at least one first recess oriented in the longitudinal direction and being oriented at right angles to at least one second recess whereby the said at least first recess intersects with the said at least one second recesses and each have a depth wherein the first and second recesses are shaped as grooved trenches wherein the second recess is deeper than the first recess.

Preferably, there are two first recesses oriented parallel with each other and three second recesses spaced along the longitudinal direction of the elongate body but being located closer to the front edge of the sill drainage member.

Preferably, the sloping surface of the sill drainage member includes a surface area between second recesses which can be sloped in one direction or in two opposing directions from the centre of the surface area.

Preferably, the protrusion includes a downwardly protruding portion which is shaped and sized to inter-fit with a complementary slot in the sash bottom rail.

Preferably, the front edge or one edge of sill drainage member includes an angled vertical surface with respect to the vertical and downwardly extending beyond the lower surface to form a downwardly pointing overhang.

Preferably, the rear edge of the sill drainage member is angled with respect to the vertical orientation.

Preferably, the lower surface of the sill drainage member is provided with an angled or non angle lower surface wherein the angle slopes downwards from the in use rear edge to the front edge of the elongate body.

Preferably, the sill drainage member includes an overhang portion located on a front edge to in use be downwardly pointing to be located over a front edge of the sash bottom rail.

Preferably the body includes at least one raised ridge member located on the upper surface which is adapted to be received by a complementary recess in the slope block.

In a second aspect the invention resides in an assembly of an insulated glazing unit (IGU) and sill drainage member, the IGU including glazing and edge sealing, and a sash frame attachable to the wall of a building including a sash bottom rail, a front timber bead, the sill drainage member having an elongate body comprising a polygonal shape with an upper surface and lower surface, the upper surface includes drainage means being adapted to drain moisture or fluid wherein the drainage means includes at least one recess to shaped and oriented collect and direct moisture or fluid away from the sill drainage member such that the sill drainage member is adapted to be located and fixed underneath the IGU and the sill drainage member is affixed to the sash bottom rail.

Preferably the IGU is fitted into a cut sash frame.

Preferably, the sill drainage member can have an angled or horizontal lower surface.

In a third aspect the invention resides in a method of installing an insulated glass unit (IGU) to an existing sash in a window assembly, the window, a sash with window glazing with a sealer, or a IGU with edge sealing, slope blocks and sash bottom rail, and sill drainage member, the sill drainage member having an elongate body comprising a polygonal shape with an upper surface and lower surface, the upper surface includes drainage means being adapted to drain moisture or fluid from a sash wherein the drainage means includes at least one recess shaped and oriented to collect and direct moisture or fluid away from the sill drainage member such that the sill drainage member is adapted to be located and fixed underneath the glazing and on top of the sash bottom rail, the method of installation including:

a) Remove the sash from the window assembly;
b) Create a rebate in the sash for a double glazed assembly in the sash, from the rear or inside, start by routing a cut in the sash ie do a rear cut, on the inside side of the window assembly, at a certain distance from the edge of the window glazing;
c) from the opposite side of the sash at the front or outside of the sash, cut towards the bottom of the rear cut to form the rebate and a separated existing glass and part frame;
d) remove the existing glass with the part frame, from the rest of the sash leaving the rest of sash as just as a timber frame;
e) tidy the rebate cuts of the sash and prime any cut surfaces;
f) cut out locating slots in a bottom rebate of the sash bottom rail to fit the sill drainage member;
g) prime exposed sash bottom rail cut rebate surface;
h) affix sill drainage member to bottom rebate cut surface of the sash bottom rail;
i) affix slope block(s) on to the sill drainage member using locating means (eg ridge in a recess);
j) fit IGU to the part sash frame;
k) fit IGU in the sash frame, to sash bottom rail and frame;
l) attach flexible beads to the front and rear of a double glazed assembly and;
m) attach timber front bead to front of sash over the front face of the part of the sill drainage member (by using vertical fasteners downwardly through the bead and down through the sill drainage member and then through and into the sash bottom rail.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

BRIEF DESCRIPTION

The invention will now be described, by way of example only, by reference to the accompanying drawings:

Angled sill drainage member

FIG. 1 is a perspective view of an angled sill drainage member in accordance with a first preferred embodiment of the invention.

FIG. 2 is a perspective view of the rear of the sill member.

FIG. 3 is an end view of the sill member.

FIG. 4 is an end view of the sill member in use in a window assembly installation with a DGU.

FIG. 5 is a top plan view of the sill member.

FIG. 6 is a bottom plan view of the sill member.

FIG. 7 is a front edge end view of the sill member.

FIG. 8 is a rear edge end view of the sill member.

Straight sill drainage member

FIG. 9 is a perspective view of the straight sill drainage member.

FIG. 10 is a perspective view of the rear of the sill member.

FIG. 11 is an end view of the sill member.

FIG. 12 is an end view of the sill member in use in a window assembly installation with a DGU.

FIG. 13 is a top plan view of the sill member.

FIG. 14 is a bottom plan view of the sill member.

FIG. 15 is a front edge end view of the sill member.

FIG. 16 is a rear edge end view of the sill member.

FIG. 17 is a schematic illustration of an insulated glass unit window assembly.

DESCRIPTION OF DRAWINGS

The following description will describe the invention in relation to preferred embodiments of the invention, namely a sill drainage member 1, double glazed assembly and method of installation. The invention is in no way limited to these preferred embodiments as they are purely to exemplify the invention only and that possible variations and modifications would be readily apparent without departing from the scope of the invention.

Various building terminology is used such a sash which generally includes a glass pane mounted in a peripheral wooden frame (i.e., a peripheral sash frame comprised of a sash bottom rail, stiles, and a top rail). When in use, the sash, when installed as part of a window assembly, will include an inside facing inside the building and an outside facing outside. The peripheral sash frame is made up sides (stiles) with a sash bottom rail and a top rail, joined together whereby there is a rebate or seat formed on an inner edge for the glass pane. A window assembly can include the sash which is seated on a window sill which is located at the base of the window assembly. The window assembly can include an outer frame and various inner frames including the sill and the frame is designed to hold and support various sashes plus putty or a bead to hold the glass in from the outside.

Often the look of wood wishes to be retained which can mean that one needs to remove the existing single glass pane and replace with a double glazing unit ie a DGU, so there is a need to allow this type of installation but provide better drainage by providing a sill drainage member. However use of sill drainage members is not limited to this combination, as the DGU can simply exist without the existing sash frame and sit on blocks and the sill drainage members.

Figure 12:
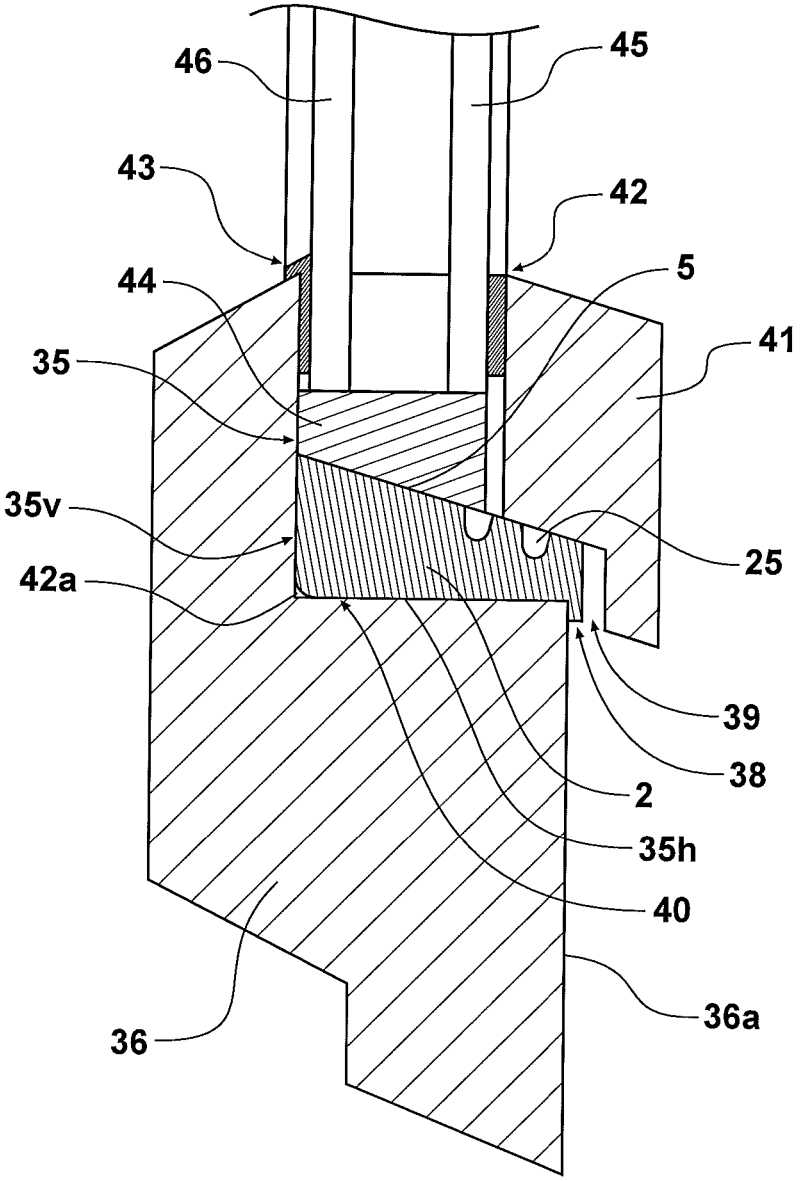
Figure 13:
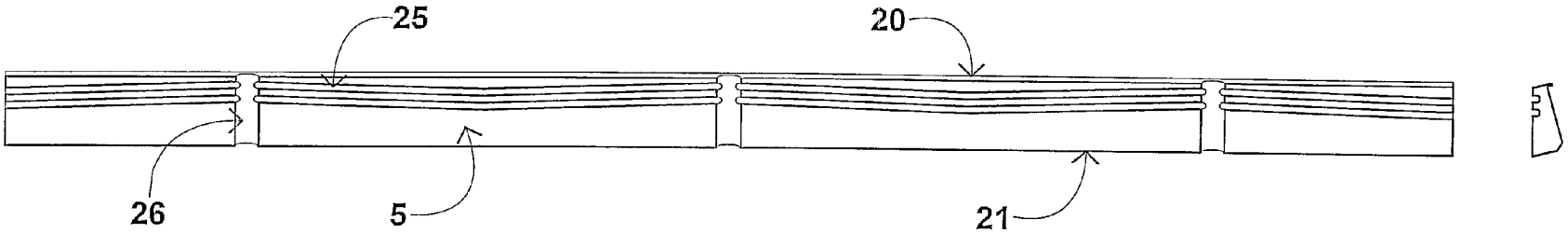
Figure 14:
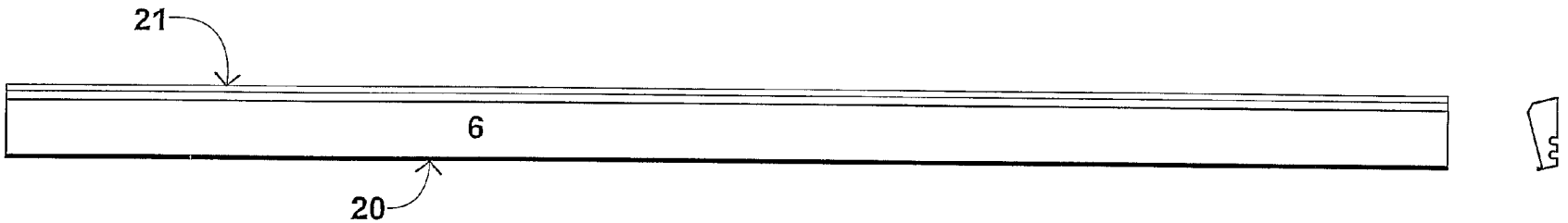
Figure 15:
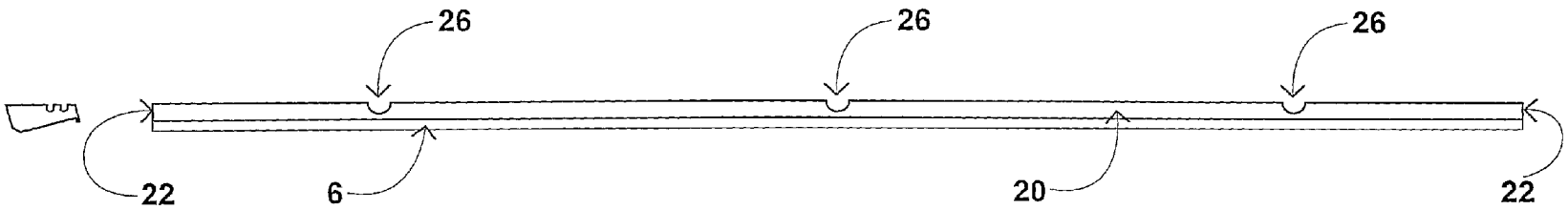
Figure 16:
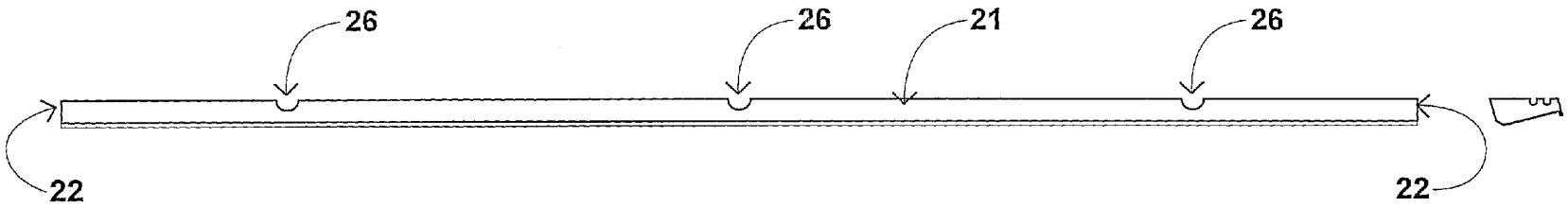
Figure 17:
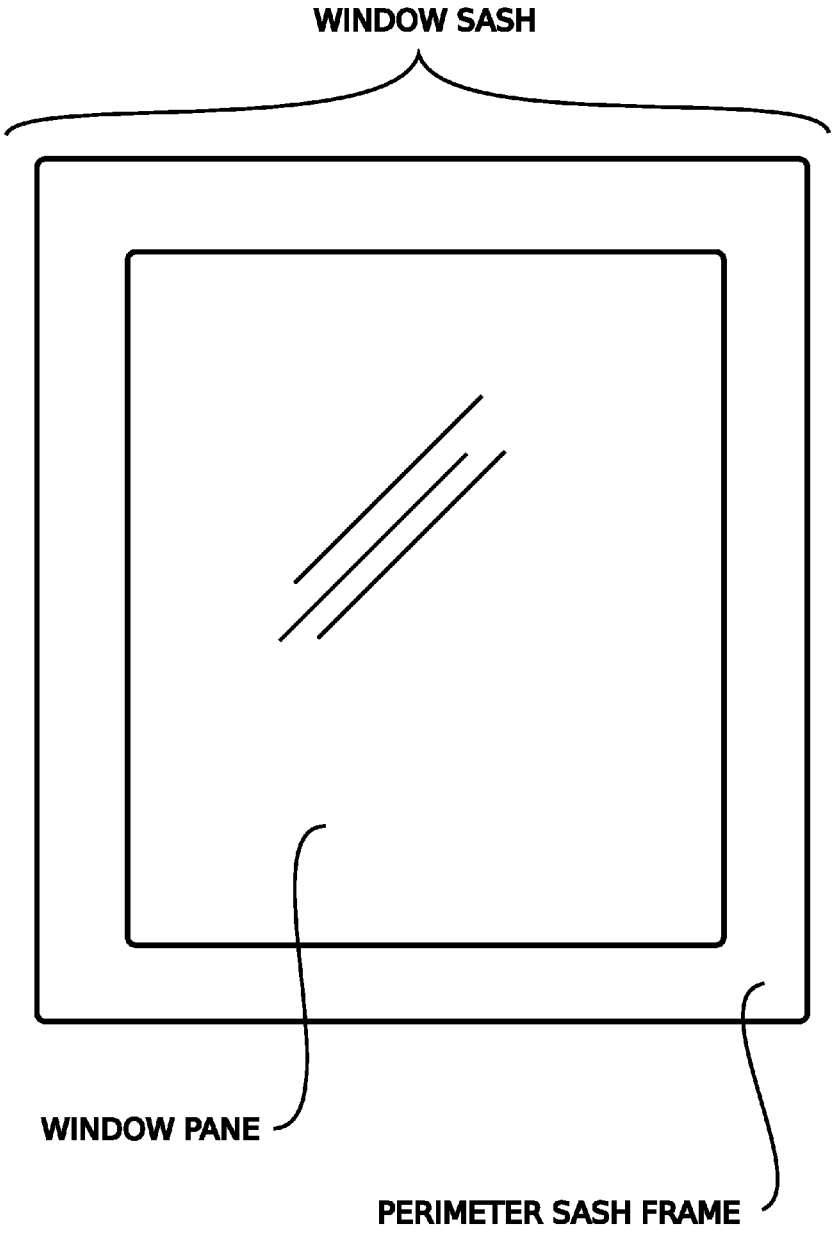

Angled sill drainage member (FIG. 4) or straight sill drainage member (FIG. 12)

Figure 1:
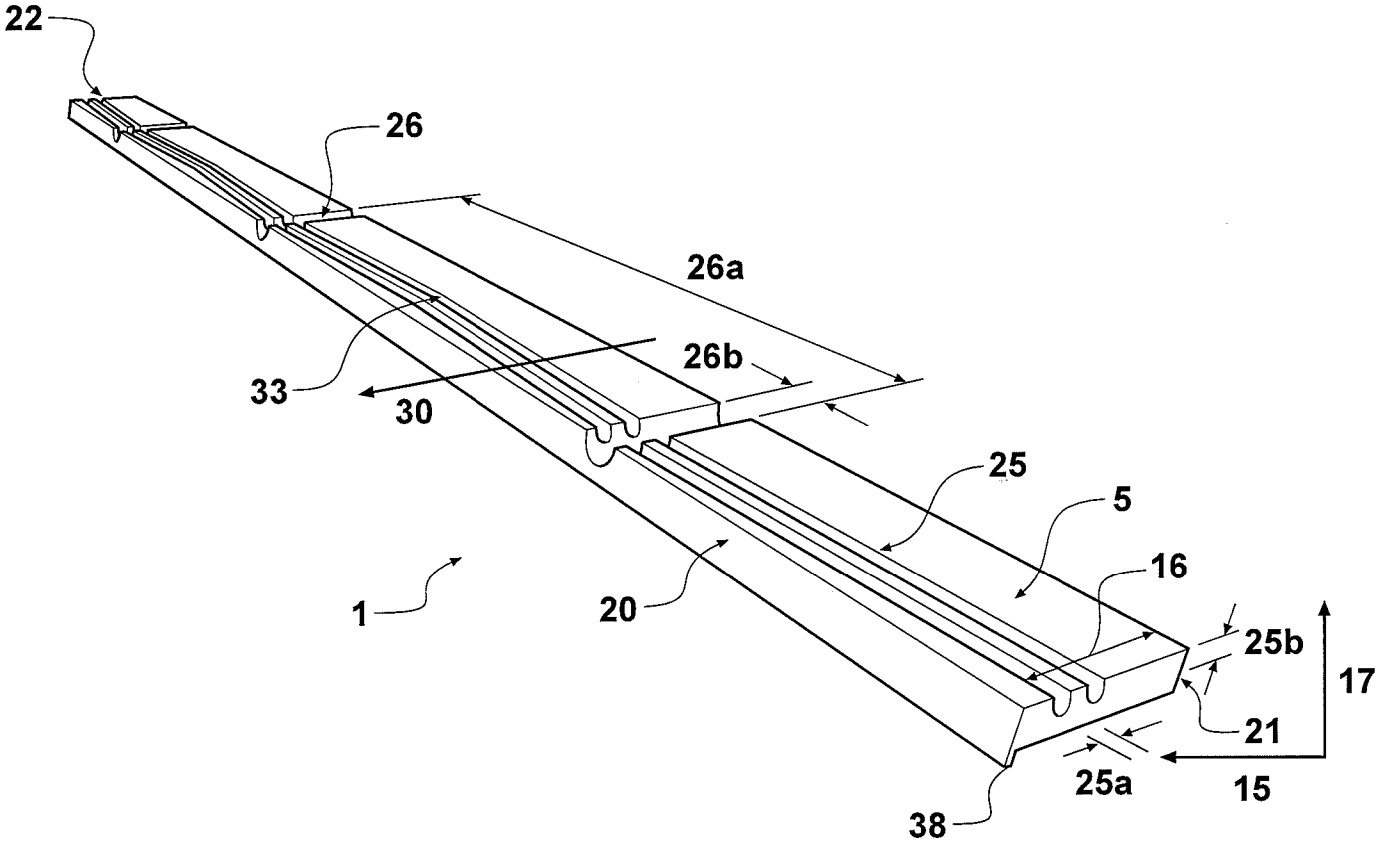
FIGS. 1-10 show the sill drainage member 1 in two forms ie as an angled drainage member as in FIGS. 1-8 and as a straight sill drainage member 2 as in FIGS. 9-16 for use in a bottom rebate of a sash (or fixed window) for a double glazed unit (DGU) or assembly which can also be termed an Insulating Glass unit (IGU). Though a double glass unit is shown and mentioned in the examples this in no way limits the use of the sill drainage member which can be used with any IGU ie no matter how many glass panes are present. In general terms a sash includes a timber frame with a glass pane (puttied in place on the outside), whereby the sash can be fixed or non-fixed to the window frame. Any DGU comes as a sealed unit including glazing and edge seal perimeter.

Sill drainage member 1 has an elongate body comprising a polygonal shape with an in use upper surface 5 and lower surface 6. Upper surface 5 includes drainage means being adapted to drain moisture or fluid. The drainage means includes at least one recess to collect and direct moisture or fluid from the sill drainage member 1 such that the sill drainage member 1 is adapted to be located and fixed underneath a window glazing. As shown in FIG. 1 there can be at least one drainage means within the upper 5 surface. The lower surface 6 is parallel as per an angled sill drainage member 1 as seen in FIGS. 1-8. If the upper and lower surfaces 5 & 6 are not parallel then one example is the other sill drainage member 2 of FIG. 9-15.

The in use lower surface 6 of sill drainage member 1 can include member locating means in the form of at least one protrusion 10 which is shaped to slidably inter-fit within at least one recess or slot provided in a sash bottom rail surface 11 to assist in locating the sill drainage member to the sash bottom rail to prevent them from fall out of the window.

The sill drainage member body is a substantially planar slender member which is located substantially in an in use horizontal plane 15, having a longitudinal direction parallel with the length direction and a transverse direction 16 located at right angles to the longitudinal direction. Upper 5 and lower surfaces 6 are separated by a thickness dimension perpendicular to these upper and lower surfaces 5 and 6 in a vertical direction 17 whereby there is a front edge 20 (say facing a user outside the window) a rear edge 21 (which can be thought of as being inside the building or on the inside of the window) and end edges 22.

The drainage means includes two features in combination to force any moisture or fluid like water, in a specified direction away from the sash and/or window assembly usually to the outside of the building. These features of the drainage means are formed as angled recesses and sloping surfaces.

Figure 11:
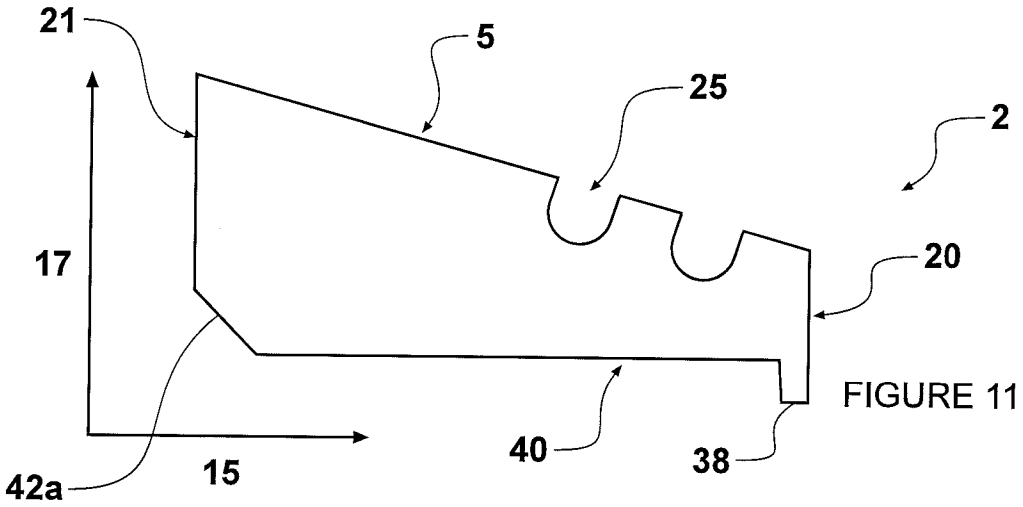

The drainage means includes at least one first recess 25 oriented in the longitudinal direction which is oriented at right angles to at least one second recess 26. Second recesses can be said to be transverse to the longitudinal recesses 25. Additionally the actual slopes of these recesses can be varied with the slope of the upper surface 5. As shown in FIGS. 1 and 11 the longitudinal recesses 25 can be sloped longitudinally from a central point. The said at least first recess 25 intersect with the said at least one second recess 26 to form a continuous drainage path. Recesses 25 and 26 can be shaped as desired but in this example the recesses 25 & 26 are shaped as grooved trenches being at least 6 mm in width 25*a* and 3 mm deep 25*b*. For example there can be a distance 26*a* of say 180-200 mm between transverse recesses 26. Transverse recesses 26 can be for example 10 mm in width 26*b*.

Figure 2:
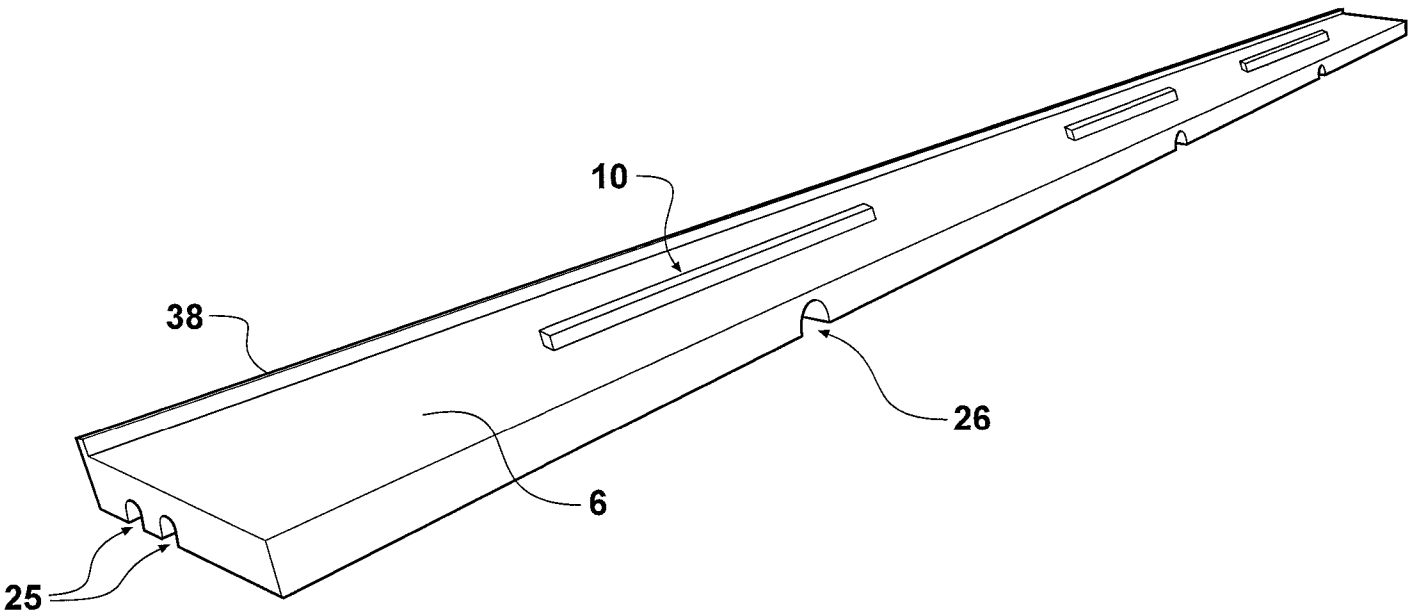

These recess depths enable moisture or fluid of a certain volume, when reaching an end of the recess, to then be forced to drop into each recess rather than being able to pass over the recess with the aid of surface tension. As shown in FIG. 2 there are two first recesses 25 oriented parallel with each other and located anywhere on the upper surface such as for example closer to the front part of the sill drainage member 1 or 2. Second recess 26 protrudes beyond the lower surface 6 to a greater or same depth as the first recesses 25. These depths, dimensions and pattern of all of the recesses can be varied as required. Typically the first recesses are deeper than the second recesses to allow fluid flow from the second to the first recesses. The first recesses can be patterned on the upper surface in parallel or not and can fan out from each second recess when looking at them in plan view.

Figure 3:
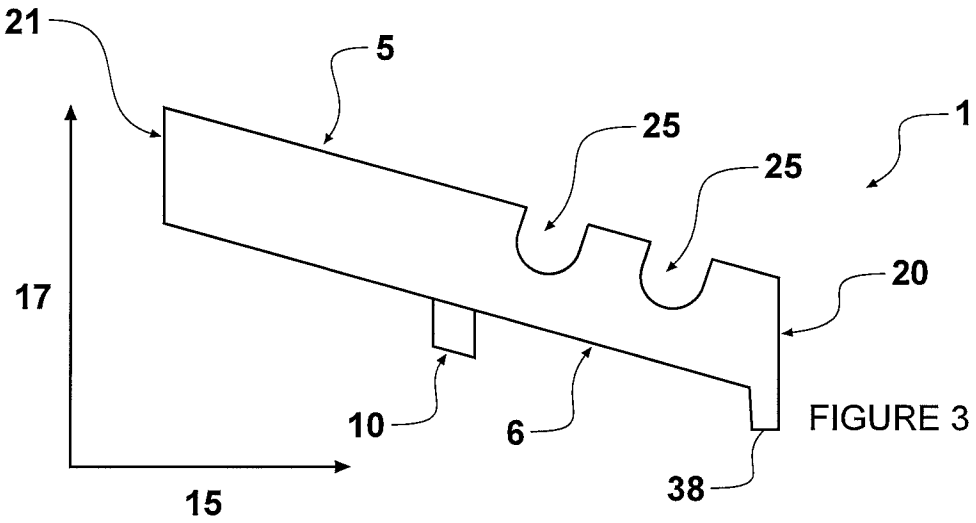
Figure 4:
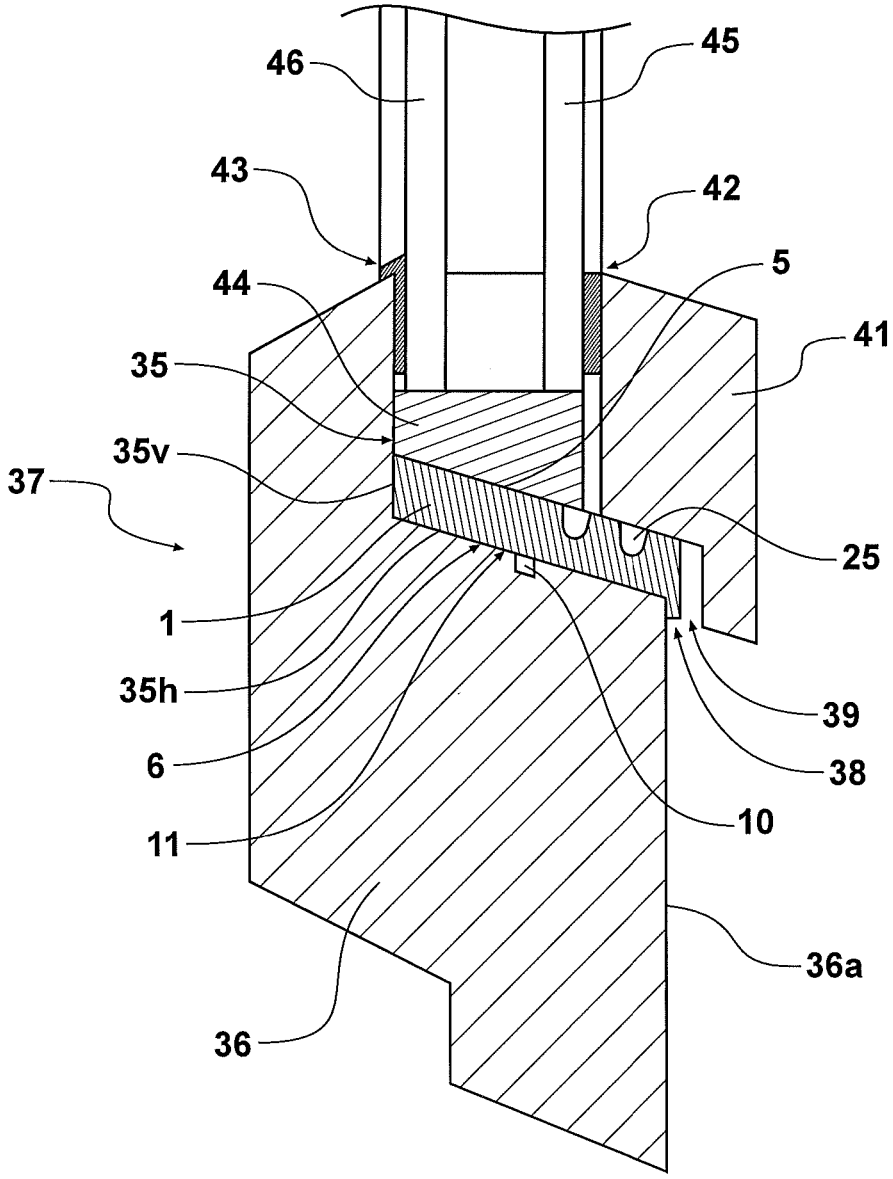
Figure 5:
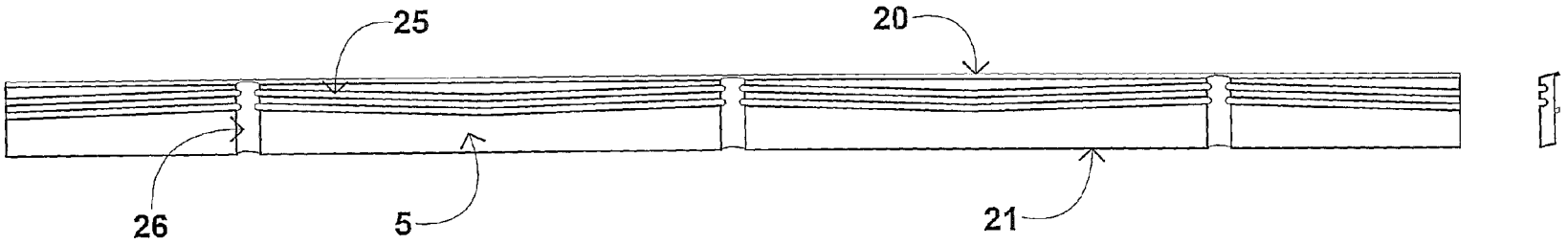
Figure 6:
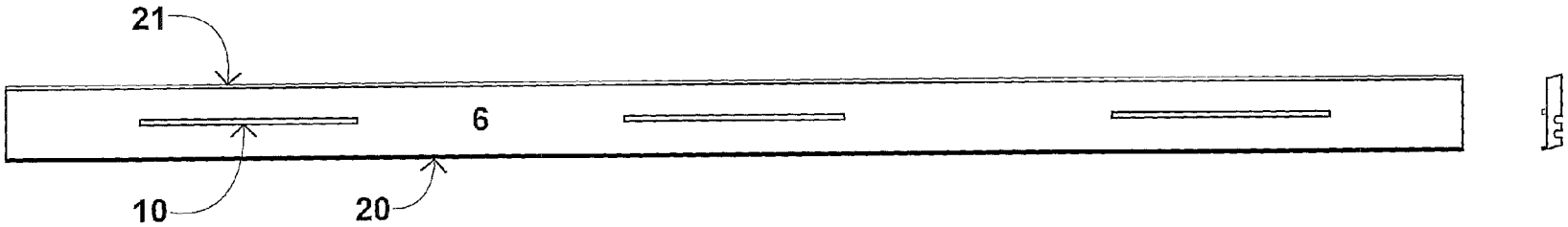
Figure 7:
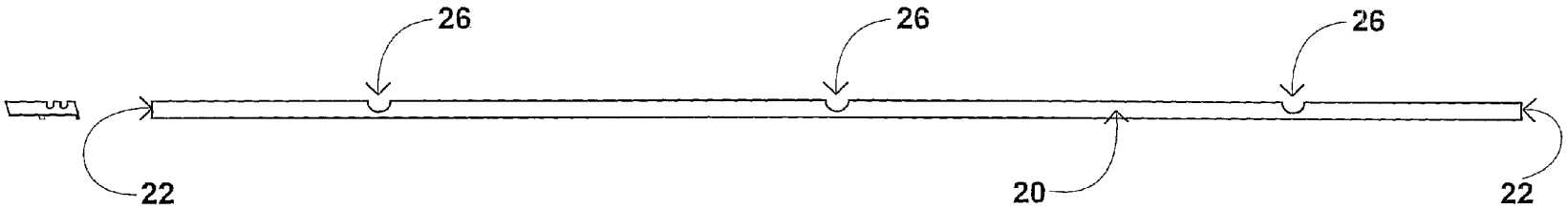
Figure 8:
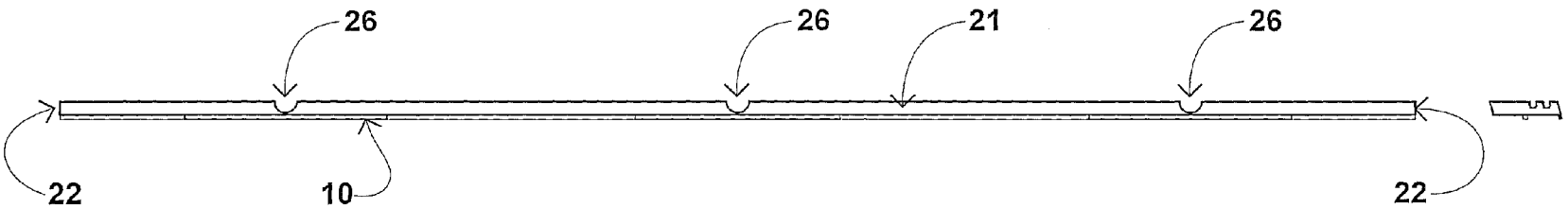
Figure 9:
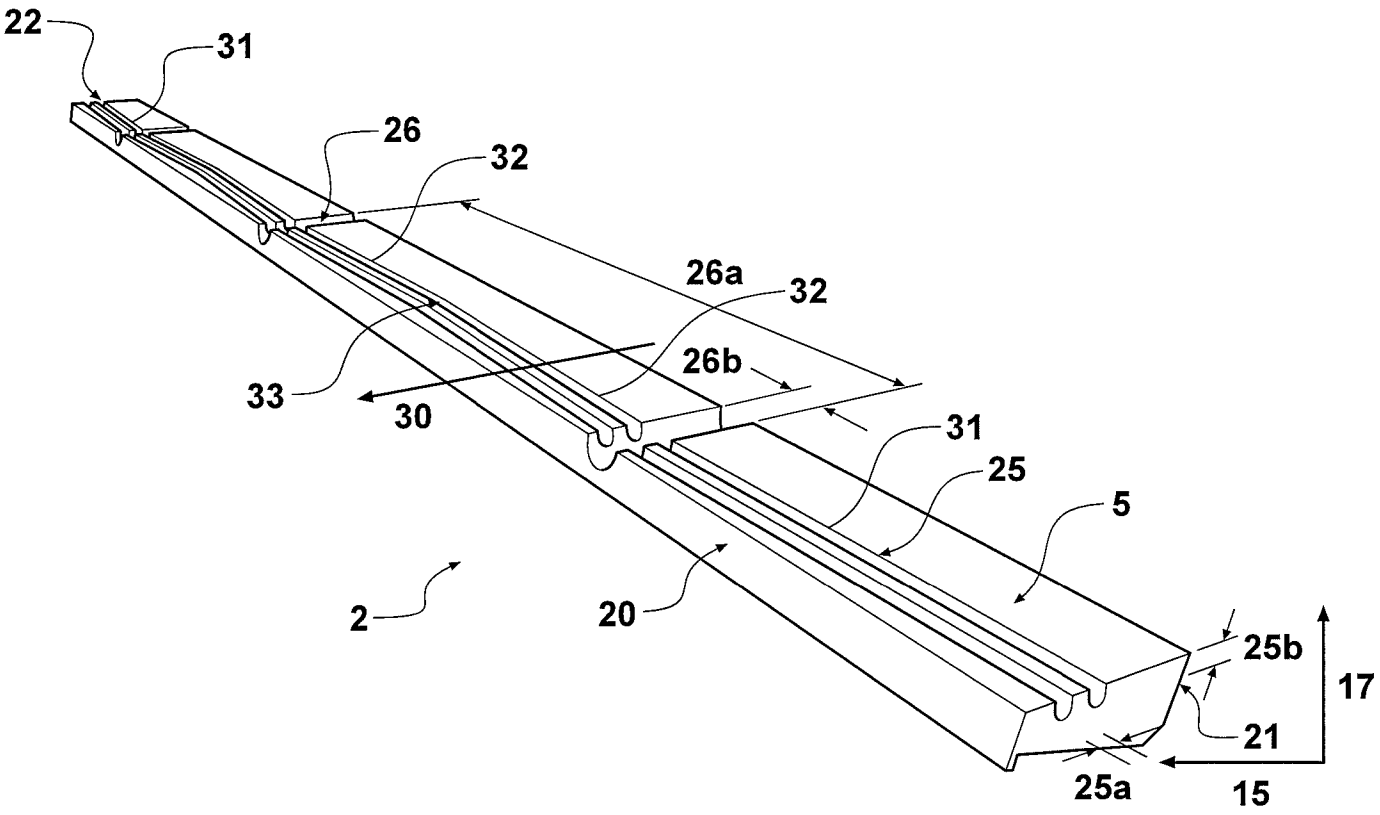

The other aspect of the drainage means is where the upper surface 5 includes a surface area which is generally sloping in a transverse direction 30 from the rear to the front of the sill drainage member body—see FIGS. 3 and 4. Other sloping occurs between second recesses 26 which can be sloped in one longitudinal direction 31 or in two longitudinal directions 32 from a centre 33 of the surface area.

The protrusion 10 comprises a raised rear surface (downwardly protruding when in use) which is shaped and sized to slidably inter-fit within a complementary seat or slot (not shown) in a seat shaped having a vertical back wall 35*v* and a horizontal surface 35*h* of the timber sash bottom rail 36 of a window assembly 37. In this example the protrusions 10 are shaped as a square cross section (though other shapes are equally possible) which extend in the longitudinal direction being essentially parallel to the front edge and rear edge and the recesses 25 & 26.

Front edge 20 of the sill drainage member 1 includes an angled surface with respect to the vertical and downwardly extending beyond the lower surface 6 to form an overhang 38. In use the overhang 38 abuts a front surface 36*a* of the timber sash bottom rail 36. The overhang 38 assists in locating the sill drainage member 1 or 2 and allows for a better fluid seal between sill drainage member 1 or 2 and exposed surface of the sash bottom rail 36. As shown in FIGS. 4 and 12 there can be a gap 39 between the sill drainage member overhang 38 and an outer timber bead 41. There can also be gaps below the seals 42 and 43 between the timber bead 41 and the block 44 and also at the back.

The rear edge 21 as seen in FIG. 1 of the sill drainage member 1 is angled with respect to the vertical being a similar slope to the front edge 20 which is adapted to sit against a rear surface of the exposed timber sill 36.

Another feature of the sill drainage member 1 or 2 is that the sill drainage member body includes at least one raised ridge member 44*a* located on the upper surface which is adapted to be received by a complementary recess in slope block. The ridge member 44*a* is located on the opposite body surface to that of the at least one protrusion 10. This ridge member 44*a* is not shown in the drawings but can be located anywhere on the upper surface 5 but for example at the rear of the upper surface 5. Also the ridge members 44*a* comprise spaced ridges though they could just one ridge member 44*a* extending along the length of the upper surface 5. The complementary recess in slope block 44 is located on an in use lower surface and can include space recesses sized to slidably receive the ridge or ridges. Any shape and spacing is sufficient as long as they allow some locating of the slope block 44. The underside of the slope block 44 can alternatively be soft enough to allow a ridge member 44*a* or protrusion from the sill body to simply upwardly piece there through the underside of the slope block 44, to frictionally hold and allow location that way.

The other sill drainage member 2 has the same features as the sill drainage member 1 but this time has a lower surface 6 formed as a horizontal surface 40. This means that the seat 35 cut out of the sill is shaped to match. A rear corner 42 can be rounded or cut off as shown in FIG. 10.

Figure 10:
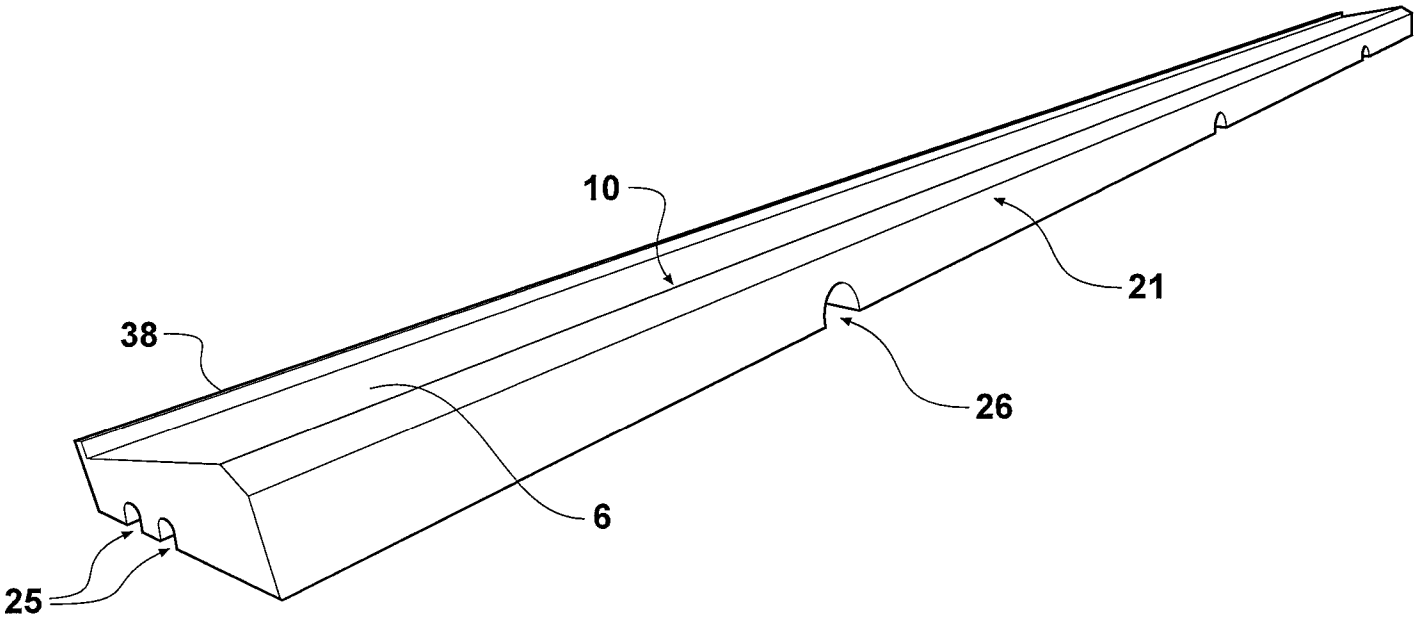

As mentioned above the sill drainage members 1 or 2 are adapted to be used and installed into a bottom rebate (35*v* and 35*h*) of a glazed window installation assembly 37 such as a single, or double glazed situation as shown in FIGS. 4 and 10.

In any retro fitting, the sash 36 is rebated all round, including the bottom to receive the sill drainage member 1 or 2 or in a new installation, the rebate is ready formed in the window frame assembly but not in the bottom. Also in a retro fitting where the sash is completely new only the sill needs to be rebated by forming a vertical 35*v* and horizontal seating 35*h*. In a retro-fit situation, for installing double glazing, the outside timber bead of an existing sash (with glass and frame with putty) generally needs replacing, as the sizes changes (ie gets larger), with a new member of say 40×25 mm profiled timber bead. The front flexible seal 42 can be a butyl strip fixed to a rear of the timber bead 41. For example, 2 mm×10 mm butyl strip or backing rubber. The rear flexible bead 43 can be self adhesive proprietary backing seals.

The slope block 44 can be a 15 degree sloping double glazing block located under IGU. The slope blocks 44 are elongate members of discrete lengths which do not necessarily extend the full width of any window so that there will be gaps in between the blocks 44 when installed to allow moisture or water etc to meet the sill drainage members 1 or 2 to then be drained away from the window assembly. Other gaps between components are shown in FIGS. 4 and 12 which allow for air and fluid circulation and ease of installation. All cut timber surfaces should be primed to get the best protection from moisture. So in combination one can put a DGU either simply in a window like as shown in FIGS. 4 and 12, on a sill drainage member, or the DGU can be fitted onto a cut wooden sash, also on a sill drainage member.

One method of installing the window assembly or IGU/DGU in an existing sash which will include a sill drainage member 1 or 2 is now described with reference to a double glazed timber window assembly 37, where the window assembly 37 can include the following main components of:

a sill drainage member 1 or 2,
sash bottom rail 36 having a seat 35,
a front timber bead 41
front and rear flexible bead or backing rubber 42 & 43
slope blocks 44 or IGU/DGU blocks,
and window glazing or panes 45 & 46.

Other components as commonly used for glazing or double glazing can be the various electrical tools such as routers with a router blade, skill saws and multi tools. The multi cutter can be a tool which almost acts like a mechanical chisel and reciprocates to allow short cuts in tight areas. Other components as known in the glazing industry but not necessarily mentioned in this specification, can be equally used such as various types of fasteners and adhesives and manual tools that do the same job as the electrical ones as mentioned.

The IGU/DGU is generally formed as a factory assembled unit by an approved IGU/DGU member ie an IGUMA member which is a body that controls members making double glazed units (DUGs).

The sill drainage member 1 or 2 has an elongate body comprising a polygonal shape with an upper surface 5 and lower surface 6. The upper surface includes drainage means adapted to drain moisture or fluid and includes at least one recess to collect and direct moisture or fluid away from the sill drainage member such that the sill drainage member is adapted to be located and fixed underneath window glazing 45 & 46 and affixed to the sash bottom rail 36.

In summary the method for changing the sash includes:

a) Orient the sash on a table with the inside facing the user;
b) Measure internal daylight size as an area measurement of a certain height and width, of a sash having glass pane fixed in a rebate in a sash frame, with putty on the outside periphery (mainly) and add so many millimeters beyond the periphery of the glass (eg 25 mm) to allow for cutting the sash frame and this will be your Insulating Glass Unit (IGU) size;
c) Now add further dimension (eg add 6 mm to the 25 mm) to each rebate position on the sash frame and draw a cut line or marker line (for the router) with a marker;
d) To save time add extra millimeters (eg 18 mm+25 mm??) now to just a bottom rebate for an angle cut;
e) Set the router blade to so many millimeters above or beyond the glass (eg 1-2 mm) on the inside of the sash—straight cut;
f) Now move the router in an anticlockwise direction around the sash bottom rail on the inside;
g) Go around, the periphery of the sash, twice to ensure a clean finish;
h) Turn the sash over to have the outside
i) Set the skill-saw depth to a certain thickness of the timber frame (eg 32 mm) and cut to the outside side of the marked line in straight line cuts except for the corners; Take care to not overcut the corners as you will use a multi cutter to finish here;
j) Then set the skill-saw to so many degrees (eg 15 degrees) and add so many millimeters (18 mm) to a bottom rebate and then cut;
k) Use the multi tool to cut the corners away to release the glass with an inner part of the sash frame;
l) Carefully tap out the existing glass taking with it the putty and wood as a whole leaving an outer sash frame;
m) Remove the whole glass and putty with an inner part of the sash frame;
n) Now tidy up the corners of sash frame with the multi tool;
o) Still on the outside, attach the set degrees router bit (eg 15 degrees) and cut a bevel for the bottom rebate; The top and side rebates should measure so many millimeters deep (eg 10-11 mm);
p) Use the multi tool to clean up bottom corners;
q) Prime the exposed rebate of the outer sash frame, check IGU for correct fit and then add backing rubber or flexible beads 42 or 43 to the rebate;
r) Place sill drainage member onto window sash bottom rail; (IGU/DGU—double glazed unit comprising two glass sheets separated by spacer)
s) Place sill blocks 44 into the bottom rebate on top of the sill drainage member 1 and 2, (use two blocks 44 of so many degree angle IGU blocks or slope block 44 are used to support the IGU in place)
t) Fit new outer beading 41 and nail off with stainless steel brads In particular for an installation method for installing double glazing either in an existing single or existing double glazing to achieve better weather tightness by installing sill drainage members 1 and 2, can include the following steps of:

a) Remove a sash from the window assembly leaving the sash bottom rail ready now for working/shaping, to fit a sill drainage member 1 and 2;
b) From the rear (ie inside the building) of the window assembly 37, to form a rebate for the sill drainage member by firstly routing a vertical cut 35*v* in the timber sill 36, inside the building side of the window a specific distance from the glass panes 45 or 46;
c) For the rest of the rebate in the window sill, from the front of the window assembly, angle cut upwards or cut level or horizontally 35*h*, to meet the bottom of the rear cut—this cut can be changed to suit the type of sill drainage member like for example angled or straight sill drainage members;

d) next tidy the cuts in sill 36 to receive the sill drainage member 1 or 2 to form an exposed sill drainage member cut receiving surface;

e) cut out locating slots in the sill 36 to fit the protrusions 10 of the sill drainage member 1 or 2;

f) prime the exposed sill cut surface;

g) affix sill drainage member 1 or 2 to primed exposed window sill cut surface 35*v* and 35*h;* h) affix double glazing slope blocks 44 on to the upper surface 5 of sill drainage member 1 or 2;

i) attach flexible beads 42 & 43 to the front and rear;

j) attach timber front bead 41 to front of window 45 or 46 over the front bead 41 and over part of the sill drainage member 1 or 2.

Advantages a) Prevents moisture entering the wall b) Prevents rotting timber sash bottom rails or window sills c) Simple and accurate installation procedure d) Modest cost e) Allows for possible guarantee for weather tightness f) Allows for retro-fitting of double glazing g) Tidy installation h) No need to replace existing window i) Energy savings j) Timber sill can be used with or without a new DGU k) Allows for the retention of a timber look with DGU with excellent drainage characteristics.

Variations

Throughout the description of this specification, the word "comprise" and variations of that word such as "comprising" and "comprises", are not intended to exclude other additives, components, integers or steps.

The sill drainage member 1 or 2 can be manufactured from PVC but other materials are also possible such as other plastics or timber or metal or in any combination. The protrusion 10 though shown as being a separate member to that of the rest of the sill drainage member 1 and 2 can equally be formed integrally with the rest of the sill drainage member body. Measurements as mentioned to be used to allow for cutting sawing or routing, although said to be taken from the edge of the glass or glazing can be equally taken from some other reference point.

The grooved trenches for the recesses 25 & 26 are shown as such a cross sectional shape but any cross sectional shape is possible such as V shaped or square shaped. Two grooves are shown located closer to the front edge than the read edge but equally one groove or many more may be used. The depths of the recesses can also be varied to suit The same applies to the shape of the lower surface protrusions 10 which can be any shape and spacing as required. For example protrusions can be shaped as discrete knob-like member if desired or if easier to form. 'Retrofitting' is just another commonly know building term for renovating an exiting structure.

This type of sill drainage member 1 or 2 can be used with other types of window arrangements such as a single glazed timber window to be converted to a double glaze situation or with renewing an existing double glaze. This can be used in retrofit or new build situations. Any type and number of glazing can be used with the sill drainage blocks and sill drainage members such as for example a single or double glazed unit can be used with a either a closed or opening sash as well. The sill drainage member 1 or 2 is shown being used in timber windows though other combinations of materials are also possible.

Priming is mentioned but other methods of sealing the exposed timber surface can also be used or in combination such as adhesive tape, gaskets or adhesive. In the method variations include attaching the flexible beads to the base of the window before installing the glass. Protrusions 10 are used with complementary located and shaped recesses to reduce or eliminate the need for fasteners that that piece the body of the sill drainage member.

The method can be varied such as by putting the slope blocks 44 on to the bottom of the DGU instead of the sill drainage member. Though no perimeter frame for the glass, is shown in FIGS. 4 and 12 a frame like the sash frame can be included in any of the assemblies as well if desired. The beads or flexible beads 42 and 43 can be placed on the sash frame or on the DGU depending on what is convenient. Also in another variation of the method, the sash bottom rail rebate can be formed to receive the sill drainage member before working or cutting the wooden sash if desired.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described. The term sash includes a frame and glass whereby the frame has a sash bottom rail at the bottom.

What we claim is:

1. An insulated glass unit window drainage assembly, comprising:

a window sash comprising a peripheral sash frame with a sash bottom rail, front and rear flat surfaces of the sash bottom rail defining a rebate with a longitudinally extending recess, the rebate being downwardly inclined to thereby define a downwardly sloped surface, the peripheral sash frame fixable in a window opening;

a sill drainage member located within the window sash on the sash bottom rail, wherein sill drainage member is for draining from inside of the peripheral sash frame to an outside of the assembly, the sill drainage member comprising i) an elongate body extending in a longitudinal direction and comprising a polygonal cross-section with a front edge, a rear edge, an upper surface extending from the front edge to the rear edge, and a lower surface extending from the front edge to the rear edge, the upper surface and the lower surface being inclined downward from the rear edge to the front edge, the lower surface of the elongate body including locating members in the form of downwardly facing protrusions, the upper surface including an planar upper surface, and ii) drainage means located in the upper surface of the elongate body and extending in the longitudinal direction, the drainage means being located to drain moisture or fluid from inside the peripheral sash frame to the outside of the assembly, wherein the drainage means includes i) at least one first recess extending in the longitudinal direction and shaped and oriented to collect the moisture or the fluid, and ii) at least one second recess that intersects said at least one first recess and runs from the rear edge to the front edge of the upper surface of the elongate body to direct the collected moisture or the collected fluid down the upper surface of the elongate body and away from the sill drainage member to the outside of the assembly;

at least one slope block with a lower surface abutting and stably resting on the planar upper surface of the sill drainage member; and an insulated glass unit (IGU) comprising at least two glass panels with an edge perimeter seal, the insulated glass unit (IGU) abutting and resting on an upper surface of the at least one slope block that rests on the planar upper surface of the sill drainage member, with the at least one slope block supporting the insulated glass unit (IGU) on the planar upper surface of the sill drainage member, and wherein the moisture outside the insulated glass unit (IGU) and within the window sash, collects and drains to the outside of the assembly via the drainage means, and wherein, the lower surface of the elongate body is located directly on top of the sash bottom rail with the downwardly facing protrusions slidably interfitting with the recess located in the rebate of the sash bottom rail whereby any moisture outside the insulated glass unit (IGU) but within the sash frame of the window is able to be drained downwardly around the slope block to the planar upper surface of the elongate body and then, via the drainage means, away to the outside of the assembly.

2. The insulated glass unit window drainage assembly as claimed in claim 1 wherein, the elongate body of the sill drainage member is a substantially planar slender member having a length and width whereby the length is located substantially in an in use plane, having a longitudinal direction parallel with the length direction and a transverse direction located at right angles to the longitudinal direction, and the upper and lower surfaces are separated by a thickness dimension perpendicular to these surfaces in a vertical direction whereby there is a front edge, a rear edge and end edges wherein the sill drainage member has an angled lower surface.

3. The insulated glass unit window drainage assembly as claimed in claim 2 wherein, the at least one first recess is oriented at right angles to the at least one second recess whereby the said at least first recess intersects with the said at least one second recess and each have a depth wherein the first and second recesses are shaped as grooved trenches wherein the second recess is deeper than the first recess.

4. The insulated glass unit window drainage assembly as claimed in claim 3 wherein, there are two, first recesses oriented parallel with each other and three second recesses spaced along the longitudinal direction of the elongate body but being located closer to the front edge of the sill drainage member.

5. The insulated glass unit window drainage assembly as claimed in claim 4 wherein, the sloping surface of the sill drainage member includes a surface area between second recesses which are sloped in one direction or in two opposing directions from the centre of the surface area.

6. The insulated glass unit window drainage assembly as claimed in claim 5 wherein, the protrusion includes a downwardly protruding portion which is shaped and sized to interfit with the recess in the sash bottom rail.

7. The insulated glass unit window drainage assembly as claimed in claim 6 wherein, the front edge or one edge of sill drainage member includes an angled vertical surface with respect to the vertical and downwardly extending beyond the lower surface to form a downwardly pointing overhang.

8. The insulated glass unit window drainage assembly as claimed in claim 7 wherein, the rear edge of the elongate member is non-perpendicular to the lower surface of the elongate member.

9. The insulated glass unit window drainage assembly as claimed in claim 8 wherein, the lower surface of the sill drainage member is provided with an angled lower surface wherein the angle slopes downwards from the rear edge to the front edge of the elongate body.

10. The insulated glass unit window drainage assembly as claimed in claim 9 wherein, the sill drainage member includes an overhang portion located on one front edge to be downwardly pointing to be located over a front edge of the sash bottom rail.

11. The insulated glass unit window drainage assembly as claimed in claim 10 wherein, the elongate body includes at least one raised ridge member located on the upper surface which is adapted to be received by a complementary recess in the at least one slope block of the window assembly.

12. The insulated glass unit window drainage assembly of claim 1, wherein, the drainage means is located at least partly beneath the lower surface of the slope block and extends in the longitudinal direction below the lower surface of the slope block, and the at least one second recess is located at least partly beneath the lower surface of the slope block.

13. The insulated glass unit window drainage assembly of claim 1, wherein, the front edge of the elongate body has a height less than a height of the rear edge of the elongate body such that the upper surface is inclined, relative to the lower surface of the elongate body, downward from the rear edge to the front edge, and the drainage means is located at least partly beneath the lower surface of the slope block and extends in the longitudinal direction below the lower surface of the slope block, and the at least one second recess is located at least partly beneath the lower surface of the slope block.

14. The insulated glass unit window drainage assembly of claim 1, wherein, the drainage means includes plural of said first recess and plural of said second recess, and at least one of said plural first recesses is located beneath the lower surface of the slope block and extends in the longitudinal direction below the lower surface of the slope block, and each of said plural second recesses is located at least partly beneath the lower surface of the slope block.

15. The insulated glass unit window drainage assembly of claim 1, wherein, the window sash further comprises a timber bead having a lower surface located against and above the upper surface of the elongate body, the drainage means includes plural of said first recess and plural of said second recess, and at least one of said plural first recesses is located beneath the lower surface of the slope block and extends in the longitudinal direction below the lower surface of the slope block, at least one of said plural first recesses is located beneath the lower surface of the timber bead of the window sash and extends in the longitudinal direction below the lower surface of the timber bead of the window sash, and each of said plural second recesses is located at least partly beneath the lower surface of the slope block and the lower surface of the timber bead.

16. An insulated glass unit window drainage assembly, comprising:

a window sash comprising a peripheral sash frame with a sash bottom rail, front and rear flat surfaces of the sash bottom rail defining a rebate with a longitudinally extending recess, the rebate thereby defining a downwardly sloped surface, the peripheral sash frame fixable in a window opening;

a sill drainage member located within the window sash on the sash bottom rail, wherein sill drainage member is for draining from inside of the peripheral sash frame to an outside of the assembly, the sill drainage member comprising i) an elongate body extending in a longitudinal direction and comprising a polygonal cross-section with a front edge, a rear edge, an upper surface extending from the front edge to the rear edge, and a lower surface extending from the front edge to the rear edge, the upper surface being inclined downward from the rear edge to the front edge, the lower surface of the elongate body including locating members in the form of downwardly facing protrusions, the upper surface including an planar upper surface, and ii) drainage means located in the upper surface of the elongate body and extending in the longitudinal direction, the drainage means being located to drain moisture or fluid from inside the peripheral sash frame to the outside of the assembly, wherein the drainage means includes i) at least one first recess extending in the longitudinal direction and shaped and oriented to collect the moisture or the fluid, and ii) at least one second recess that intersects said at least one first recess and runs from the rear edge to the front edge of the upper surface of the elongate body to direct the collected moisture or the collected fluid down the upper surface of the elongate body and away from the sill drainage member to the outside of the assembly;

at least one slope block with a lower surface abutting and stably resting on the planar upper surface of the sill drainage member; and an insulated glass unit (IGU) comprising at least two glass panels with an edge perimeter seal, the insulated glass unit (IGU) abutting and resting on an upper surface of the at least one slope block that rests on the planar upper surface of the sill drainage member, with the at least one slope block supporting the insulated glass unit (IGU) on the planar upper surface of the sill drainage member, and wherein the moisture outside the insulated glass unit (IGU) and within the window sash, collects and drains to the outside of the assembly via the drainage means, and wherein, the lower surface of the elongate body is located directly on top of the sash bottom rail with the downwardly facing protrusions slidably interfitting with the recess located in the rebate of the sash bottom rail whereby any moisture outside the insulated glass unit (IGU) but within the sash frame of the window is able to be drained downwardly around the slope block to the planar upper surface of the elongate body and then, via the drainage means, away to the outside of the assembly.

17. The insulated glass unit window drainage assembly as claimed in claim 16, wherein the elongate body of the sill drainage member is a substantially planar slender member having a length and width whereby the length is located substantially in an in use plane, having a longitudinal direction parallel with the length direction and a transverse direction located at right angles to the longitudinal direction, and the upper and lower surfaces are separated by a thickness dimension perpendicular to these surfaces in a vertical direction whereby there is a front edge, a rear edge and end edges wherein the sill drainage member has a horizontal lower surface.

* * * * *